United States Patent [19]

Moertel

[11] 3,946,465

[45] Mar. 30, 1976

[54] STRINGER FOR A SLIDE FASTENER

[75] Inventor: George B. Moertel, Conneautville, Pa.

[73] Assignee: Textron Inc., Providence, R.I.

[22] Filed: Jan. 9, 1975

[21] Appl. No.: 539,615

[52] U.S. Cl. ..... 24/205.1 C; 24/205.16 C
[51] Int. Cl.[2] ..... A44B 19/12; A44B 19/34
[58] Field of Search 24/205.1 C, 205.13 C, 205.16 C

[56] References Cited

UNITED STATES PATENTS

| | | | |
|---|---|---|---|
| 1,581,751 | 4/1926 | Marinsky | 24/205.16 C |
| 3,484,906 | 12/1969 | Yoshida | 24/205.1 C |
| 3,665,561 | 5/1972 | Heimberger | 24/205.16 C |
| 3,667,089 | 6/1972 | Porepp | 24/205.13 C |
| 3,831,228 | 8/1974 | Jakob | 24/205.16 C |
| 3,854,174 | 12/1974 | Yoshida | 24/205.16 C |
| 3,855,671 | 12/1974 | Fujisaki | 24/205.13 C |

FOREIGN PATENTS OR APPLICATIONS

| | | | |
|---|---|---|---|
| 1,086,520 | 10/1967 | United Kingdom | 24/205.1 C |
| 239,088 | 6/1962 | Australia | 24/205.13 C |

*Primary Examiner*—Bernard A. Gelak

[57] ABSTRACT

A stringer for a slide fastener has a continuous filamentary coupling element attached to an edge of a tape with a pair of spaced elongated members, such as textile cords, interposed between and secured to leg portions of each section of the coupling element. The spaced pair of elongated members provide stability to the continuous coupling element.

10 Claims, 13 Drawing Figures

FIG. 1
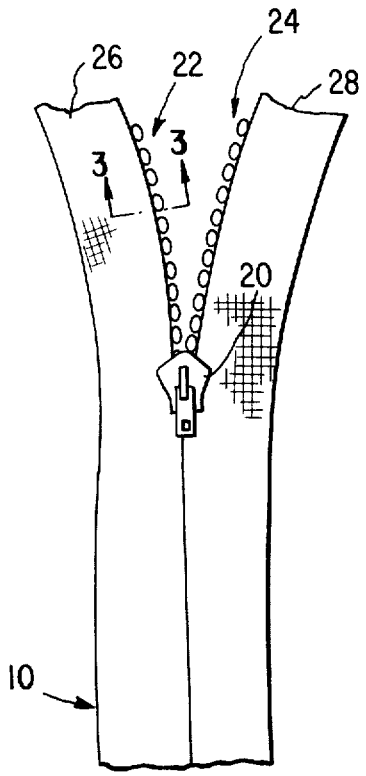
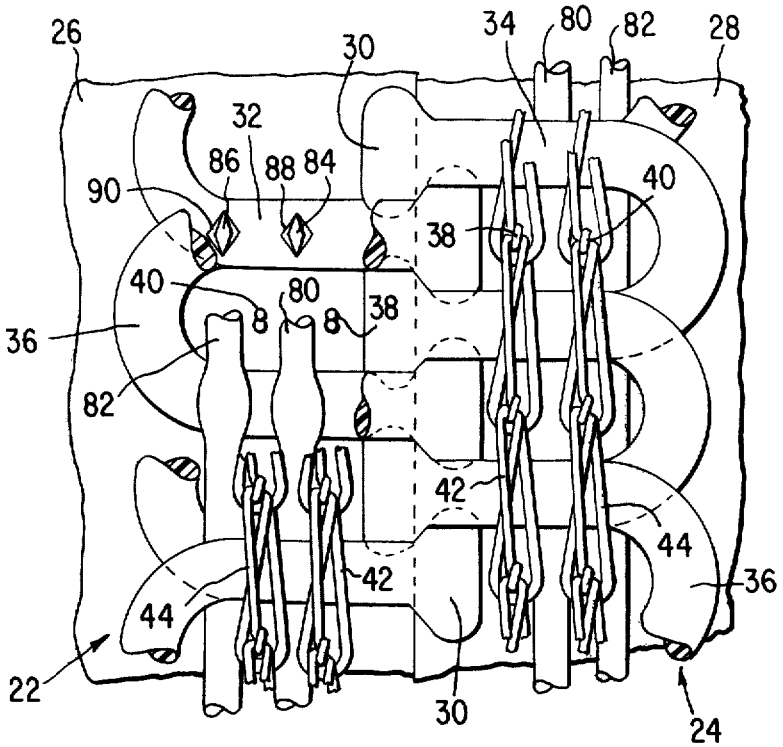
FIG. 2
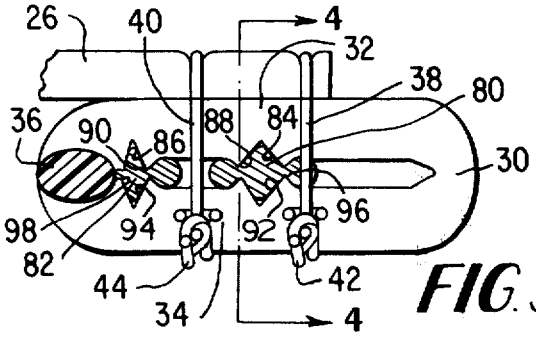
FIG. 3
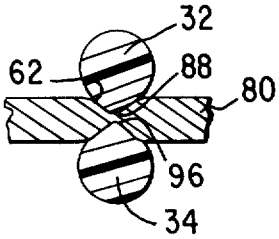
FIG. 4
FIG. 5
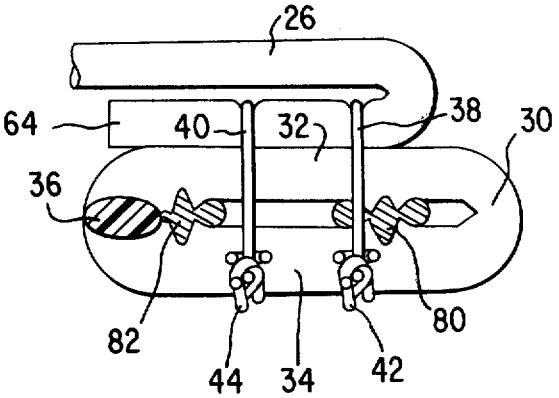

FIG 6
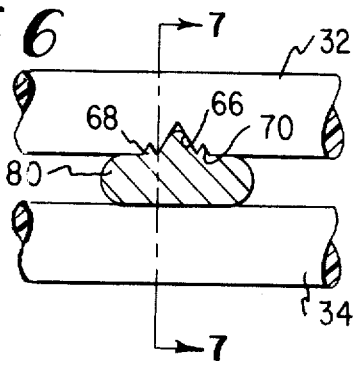
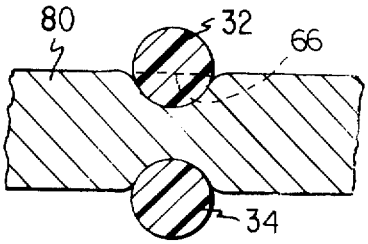
FIG. 7
FIG. 8
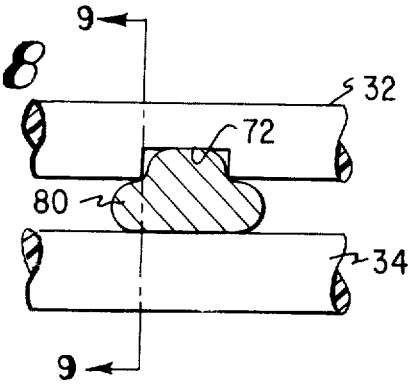
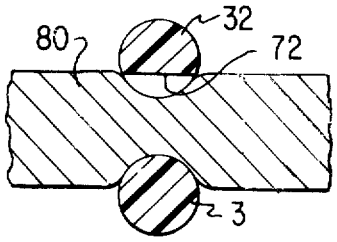
FIG. 9
FIG. 10
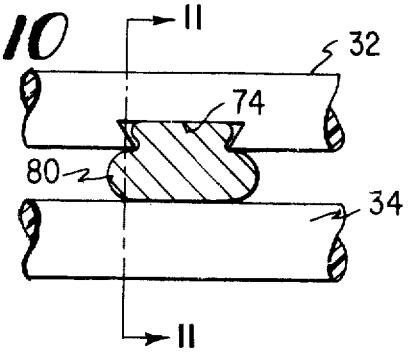
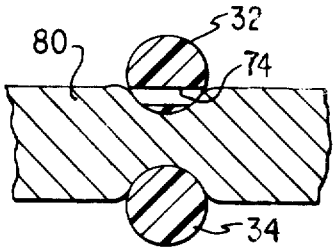
FIG. 11
FIG. 12
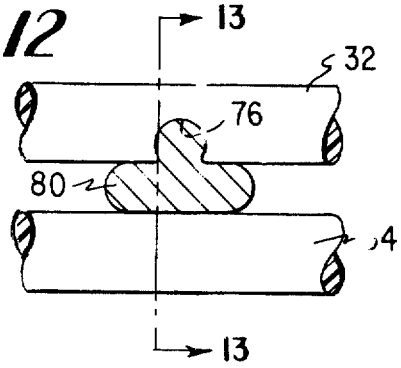
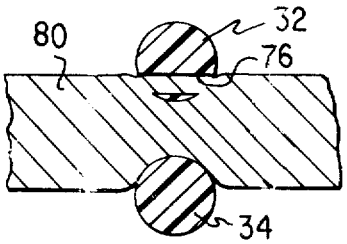
FIG. 13

STRINGER FOR A SLIDE FASTENER

BACKGROUND OF THE INVENTION

1. Field of the Invention

The invention relates to slide fasteners and particularly to slide fasteners having coupling elements formed from continuous filamentary materials secured to the adjoining edges of an opening for opening and closing the opening.

2. Description of the Prior Art

Prior art slide fasteners, such as illustrated in U.S. Pat. Nos. 1,581,751, 3,283,379, 3,290,747, 3,359,604, 3,665,561, 3,750,260, 3,783,476, and 3,789,465, employ coupling elements formed from continuous filaments with leg portions of the coupling elements secured by stitching threads to adjacent edges of respective carrier tapes; such slide fasteners depend upon the carrier tapes to provide longitudinal and transverse dimensional stability to the filamentary coupling element. Thus, these prior art slide fasteners employed relatively heavy or strong and dimensionally stable tapes for supporting the filamentary interlocking elements. In certain types of garments, such as those formed from relatively sheer materials, knitted materials, or the like, the relatively heavy tapes or prior art slide fastener degrade the appearance of the garments or their flexibility. Some of the prior art slide fasteners employed filler cords or elongated members extending between leg portions longitudinally in the filamentary coupling elements to aid in the attachment of the coupling elements by stitched or woven threads to the edges of the tapes; such slide fasteners still depending primarily upon the strength and rigidity of the carrier tape for longitudinal and transverse dimensional stability of the slide fastener stringers.

Great Britain Patent Specification No. 1,305,790 discloses a meander shape stringer having alternate short and long loops with a strip welded between the legs of the longer loops and the interconnecting curves of the shorter loops, the welded arrangement ensuring spacing between coupling element; coupling elements having their leg portions all welded together are generally deficient in flexibility, ease of operation, reliability, economy of manufacture, or the like.

SUMMARY OF THE INVENTION

The invention is summarized in that a stringer for a slide fastener includes a tape-like attachment portion; a coupling element disposed along one edge of the attachment portion and being formed from a continuous filament into successive coupling sections; each section having a head portion, a pair of elongated leg portions extending from opposite sides of the head portion, and a connecting portion interconnecting to a leg portion of an adjoining section; thread means securing each section to the attachment portion; a pair of elongated members spaced apart in a plane parallel the attachment portion and extending throughout the length of the coupling element between and transverse the pair of leg portions of each section for maintaining the pair of leg portions of each section in spaced relationship; at least one of the pair of leg portions of each section being secured to the pair of elongated members for restraining longitudinal and transverse movement of the pair of leg portions relative to the pair of elongated members; and the pair of elongated members being dimensionally stable in their longitudinal dimensions whereby the leg portions of the coupling element and the elongated members form a dimensionally stable mesh.

An object of the invention is to construct a stringer for a slide fastener having continuous filamentary coupling elements which do not require dimensionally stable support tapes.

Another object of the invention is to eliminate the necessity of the supporting or tape portions of the slide fasteners meeting the functional requirements of longitudinal strength, coil stabilization, slider guidance and the like.

Still another object of the invention is to provide a continuous filamentary coupling element with leg portions secured to spaced internal elongated members to produce a mesh having stable dimensions.

It is also an object of the invention to construct a fastener employing interlocking continuous filamentary coupling elements wherein spaced pairs of elongated members within the coupling elements impart longitudinal and transverse strength to the coupling elements to enhance crosswise strength while improving flexibility of the fasteners.

One feature of the present invention is that one of a pair of superimposed leg portions of a continuous filamentary coupling element is provided with a pair of teeth, grooves, or the like, which grip or mechanically interlock with a pair of elongated members having resilient cross sections interposed between the leg portions.

An advantage of the invention is than a pair of spaced and interposed longitudinal members in a filamentary coupling element forms an integral part thereof directly transferring longitudinal and transverse forces from head to head in the coupling element to insure consistent operation under high loading levels.

A further advantage of the invention is that a pair of interposed resilient members control the translation of forces between superimposed legs of a filamentary coupling element to provide improved operation under high stress loading.

Other objects, features and advantages of the invention will be apparent from the following description when taken in conjunction with the accompanying drawing.

BRIEF DESCRIPTION OF THE DRAWINGS

FIG. 1 is a plan view of a slide fastener in accordance with the invention.

FIG. 2 is a bottom detail view of a portion of a chain of the slide fastener of FIG. 1.

FIG. 3 is a cross section view taken along line 3—3 of FIG. 1.

FIG. 4 is a cross section view taken along line 4—4 of FIG. 3.

FIG. 5 is a view similar to FIG. 3 of a modified slide fastener in accordance with the invention.

FIG. 6 is a cross section view of an elongated member and a pair of leg portions of a coupling element in a second variation of the slide fastener in accordance with the invention.

FIG. 7 is a cross section view taken along line 7—7 of FIG. 6.

FIG. 8 is a cross section view of an elongated member and a pair of leg portions in a third variation of the slide fastener in accordance with the invention.

FIG. 9 is a cross section view taken along line 9—9 of FIG. 8.

FIG. 10 is a cross section view of an elongated member and a pair of leg portions in a fourth variation of the slide fastener in accordance with the invention.

FIG. 11 is a cross section view taken along line 11—11 of FIG. 10.

FIG. 12 is a cross section view of an elongated member and a pair of leg portions in a fifth variation of the slide fastener in accordance with the invention.

FIG. 13 is a cross section view taken along line 13—13 of FIG. 12.

DESCRIPTION OF THE PREFERRED EMBODIMENT

As illustrated in FIG. 1, the present invention is embodied in a slide fastener including a slider 20 mounted for sliding movement along coupling elements indicated generally at 22 and 24 disposed along adjacent edges of respective attachment portions or planarly disposed tapes 26 and 28. The element 22 and the tape 26 form a left stringer while the element 24 and the tape 28 form a right stringer. The coupling elements 22 and 24 are capable of closing and opening with each other in response to movement of the slider 20.

As shown in FIG. 2, each of the coupling elements 22 and 24 is formed from a continuous filament, such as a polyester or nylon monofilament, into successive coupling sections each of which include a head portion 30, an upper leg portion 32, a lower leg portion 34, and a connecting or heel portion 36 interconnecting leg portions of adjoining sections. The leg portions 32 and 34 of each section extend from respective upper and lower ends of the head portion 30 and are superimposed such that they extend parallel in a respective plane perpendicular to the adjoining edges of the tapes 26 and 28. As illustrated in FIGS. 2 and 3, the leg portions 32 and 34 of each coupling element 22 and 24 extend over one side of the respective tapes 26 and 28 contiguous the adjacent edges of the tapes 26 and 28 and are secured to the tapes by threads such as needle threads 38 and 40 and looper threads 42 and 44.

The coupling elements 22 and 24 may be a coil or ladder type such as the round coil ladder type shown in FIGS. 1, 2 and 3. In the round coil ladder type, the connecting portions 36 connect the upper leg portion 32 of each section to the lower leg portion 34 of a respective contiguous section to form a continuous coil or spiral through out the length of the elements 22 and 24.

As shown in FIGS. 2, 3, and 4, a pair of elongated members 80 and 82 having generally round cross sections extend between the leg portions 32 and 34 longitudinally in each of the coupling elements 22 and 24 parallel to the tapes 26 and 28. The elongated member 82 is positioned next to the heel portions 36 while the elongated member 80 is spaced from the elongated member 82 generally midway between ends of the leg portions 32 and 34. The elongated members 80 and 82 are formed from a material, such as a textile material, which is flexible and substantially more resilient or deformable in cross section than the filamentary material in the coupling elements 22 and 24. The elongated members are further selected to have a predetermined longitudinal dimensional stability or elasticity.

The leg portions 32 and 34 are secured, such as by interlocking, bonding, or the like, to the elongated members 80 and 92 to form a dimensionally stable mesh. The leg portion 32 of each section has detents or grooves 84 and 86 and teeth or projections 88 and 90 and the leg portion 34 has similar detents or grooves 92 and 94 and teeth or projections 96 and 98. The grooves 84, 86, 92 and 94 and the teeth 88, 90, 96 and 98 are formed by upset grooving facing surfaces of the leg portions 32 and 34. The grooves 84, 86, 92 and 94 are formed perpendicular to the longitudinal dimensions of the leg portions 32 and 34 with the grooves 84 and 92 aligned on opposite sides of the elongated members 80 and with the grooves 86 and 94 aligned on opposite sides of the elongated members 82. The leg portions 32 and 34 are biased toward each other such that the elongated members 80 and 92 are engaged and distorted and are resiliently deformed so that the portions of the elongated members engaged by the leg portions 32 and 34 are conformed to the topography of the surface portions in and around the respective grooves 84, 86, 92 and 94. The teeth 88, 90, 96 and 98 displace portions of the resilient members 80 and 92 to interlock therewith. The grooves 84 and 93 have V-shaped cross sections which have an area substantially less than the cross sectional area of the elongated resilient members 80 and the grooves 86 and 94 have V-shaped cross sections which have an area substantially less than the cross sectional area of the elongated resilient members 82 such that the members 80 and 92 are distorted inward by the walls of the grooves 84, 86, 92 and 94 to form abutment portions 62 engaging and interlocking with the sides of the leg portions 32 and 34 at the ends of the grooves 84, 86, 92 and 94. The grooves 84, 86, 92 and 94 and the teeth 88, 90, 96 and 98 have relatively, sharp edges for gripping or biting into the elongated member 50. Planar surfaces forming sides of the grooves 84, 86, 92 and 94 and sides of the teeth 88, 90, 96 and 98 engage substantial surface portions of the respective members 80 and 92 to form a wall tending to prevent movement of the elongated members 80 and 92 in a direction longitudinal of the leg portions 32 and 34.

In addition to the interlocking structure of the leg portions 32 and 34 and the elongated members 80 and 82, the elongated members 80 and 82 may be bonded such as by welding, by an adhesive, or the like, to the leg portions 32 and 34; the interlocking structure of the leg portions 32 and 34 with the elongated members 80 and 82 greatly improving the strength of such bonds.

In operation of the slide fastener of FIG. 1, the slider 20 bends the coupling elements 22 and 24 in the plane of the tapes 26 and 28 to open the spacing between the head portions 30 at the bends to allow interengagement or disengagement of the head portions 36 of the coupling elements 22 and 24 to close or open the slide fastener by movement of the slider 20.

The mesh formed by the elongated members 80 and 82 and the leg portions 32 and 34 maintains the coupling elements 22 and 24 generally straight and controls head to head skew without degrading the flexibility of the coupling elements 22 and 24. The location of the members 80 and 82 within the coupling elements 22 and 24 produces greatly improved flexibility of the slide fastener since tapes having stiffness or resistance to transverse bending can be eliminated or replaced by more flexible tapes. Further, elimination of the necessity of strong tapes can reduce curvature of the fasteners due to torque of the tapes on the coupling elements.

The elongated members 80 and 82 having deformed portions interlocking with the grooves 84, 86, 92 and 94 and the teeth 88, 90, 96 and 98 on the leg portions 32 and 34 maintain the longitudinal spacing between the leg portions of adjacent sections. The resilience of the elongated members 80 and 92 allows controlled pivotal, transverse and longitudinal elastic movement of the leg portions 32 and 34 relative to the elongated members 80 and 82 and each other where the coupling elements 22 and 24 are bent by the slider 20; this insures easy and reliable operation.

Longitudinal and transverse forces applied to the head portions 30 by crosswise stress on the slide fasteners is distributed and transfered by the elongated members 80 and 82 both between the leg portions 32 and 34 of each section and between the leg portions of adjoining sections; such distribution increasing the crosswise strength of the slide fastener.

The elongated members 80 and 82 provide the function normally associated with the carrier tapes of prior art slide fasteners. Thus, the necessity of carrier tapes providing longitudinal and transverse dimensional stability to the slide fastener is eliminated. Attaching portions or tapes 26 and 28 for the slide fasteners can be knitted materials, relatively sheer materials, edge portions of an opening in a garment seam, or the like which do not offer any substantial stability to the coupling elements 22 and 24; thus the attaching portions 26 and 28 can be selected to avoid degrading the appearance of the garment without deteriorating slide fastener strength and performance.

A modification of the slide fastener as shown in FIG. 5, has parts identified by numerals used to identify parts in FIG. 3, indicating that such parts have similar structure and function. In the modification of FIG. 5, the attachment portion or tape 28 is folded to form an underneath folded portion 64 to which the coupling element 24 is attached by the threads 38, 40, 42 and 44. Thus, the adjacent edges of tapes of a slide fastener employing the modification of FIG. 5 are folded and hide the coupling elements to produce the appearance of a sewn garment seam. Also it is noted that the elongated member 80 is positioned more toward the head 30 than in the fastener of FIG. 3.

Variations of the grooves and teeth which may be formed in one or both leg portions 32 and 34 to grip the elongated members 80 and 92 are illustrated in FIGS. 6, 7, 8, 9, 10, 11, 12, and 13. In the variation of FIGS. 6 and 7, a central V-shaped groove 66 and smaller parallel contiguous V-shaped grooves 68 and 70 are formed by cutting away surface portions of the leg 32 to produce sharp edges or teeth for gripping the member 80. A groove 72 with a rectangular cross section, shown in the variation of FIGS. 8 and 9, is cut in the leg portion 32 to form edges to grip and restrain the member 80. In FIGS. 10 and 11, a groove 74 having a sharp dovetail cross section is formed in the leg portion 32 to receive and grip the elongated member 80. A groove 76, FIGS. 12 and 13, similar to groove 74 except the groove 76 has a rounded cross section, is formed in the leg portion 32 of the variation of FIGS. 12 and 13 to grip the member 80.

Since many variations, modifications, and changes in detail may be made to the presently described embodiments it is intended that all matter in the foregoing description and shown in the accompanying drawings be interpreted as illustrative and not in a limiting sense.

What is claimed is:

1. A stringer for a slide fastener comprising a tape-like attachment portion;

a coupling element disposed along one edge of the attachment portion and being formed from a continuous filament into successive sections;

each section having a head portion, a pair of elongated leg portions extending from opposite sides of the head portion, and a connecting portion interconnecting to a leg portion of an adjoining section;

thread means securing each section to the attachment portion;

a pair of elongated members spaced apart in a plane parallel the attachment portion and extending throughout the length of the coupling element between and transverse the pair of leg portions of each section for maintaining the pair of leg portions of each section in spaced relationship;

means securing at least one of said pair of leg portions of each section to the pair of elongated members for restraining longitudinal and transverse movement of the pair of leg portions relative to the pair of elongated members and for maintaining the pair of elongated members spaced apart; and said pair of elongated members being dimensionally stable in their longitudinal dimensions whereby the one leg portions of the coupling element and the elongated members form a dimensionally stable mesh.

2. A stringer for a slide fastener as claimed in claim 1 wherein the pair of elongated members are spaced apart by at least about one-half the length of the leg portions.

3. A stringer for a slide fastener as claimed in claim 1 including a pair of detents formed on the one leg portion of section section, said pair of elongated members being resiliently deformable in cross section and having respective portions deformed into the pair of detents to interlock therewith.

4. A stringer for a slide fastener as claimed in claim 1 including a pair of teeth projecting from the one leg portion of each section interlocking with respective members of the pair of elongated members.

5. A stringer for a slide fastener as claimed in claim 1 wherein the coupling element includes a pair of grooves formed transversely in one leg portion of each section aligned with respective members of the pair of elongated members;

said pair of elongated members are resiliently deformable in cross section and have cross sections which are substantially larger in area than the area of the cross sections of the respective grooves; and said pair of elongated members are forced into the respective grooves by the other leg portion of each section whereby the respective elongated members are resiliently deformed such that the edges of the grooves interlock with the filamentary members.

6. A stringer for a slide fastener as claimed in claim 5 wherein the cross section of each groove is V-shaped and the cross section of each elongated element is round.

7. A stringer for a slide fastener comprising a tape-like attachment portion;

a coupling element disposed along one edge of the attachment portion and being formed from a continuous filament into successive sections;

each section having a head portion, a pair of elongated leg portions extending from opposite sides of the head portion, and a connecting portion interconnecting to a leg portion of an adjoining section;

thread means securing each section to the attachment portion;

a pair of elongated members spaced apart in a plane parallel the attachment portion and extending throughout the length of the coupling element between and transverse the pair of leg portions of each section for maintaining the pair of leg portions of each section in spaced relationship;

at least one of said pair of leg portions of each section being secured to the pair of elongated members for restraining longitudinal and tranverse movement of the pair of leg portions relative to the pair of elongated members;

said pair of elongated members being dimensionally stable in their longitudinal dimensions whereby the one leg portions of the coupling element and the elongated members form a dimensionally stable mesh;

said coupling element including a pair of grooves formed transversely in one leg portion of each section aligned with respective members of the pair of elongated members;

said pair of elongated members being resiliently deformable in cross section and having cross sections which are substantially larger in area than the area of the cross sections of the respective grooves;

said pair of elongated members being forced into the respective grooves by the other leg portion of each section whereby the respective elongated members are resiliently deformed such that the edges of the grooves interlock with the filamentary members; and a pair of teeth projecting from the one leg portion of each section adjacent a side of each groove and interlocking with the respective elongated resilient members.

8. A stringer for a slide fastener as claimed in claim 1 wherein the pair of elongated members are resiliently deformable in cross section, and both of the pair of leg portions of each section have means formed on mutual facing surface portions for deforming portions of the pair of elongated members and for interlocking with the deformed portions to restrain both longitudinal and transverse movement of the pair of leg portions of each section relative to the pair of elongated members.

9. A stringer for a slide fastener as claimed in claim 1 wherein the coupling element is a coil and the pair of elongated members extend within the coil.

10. A slide fastener comprising a pair of stringers and a slider on the stringers for opening and closing the stringers wherein each stringer includes a tape;

a coupling element disposed along one edge of the tape and being formed from a continuous filament into successive coupling sections;

each section having a head portion, a pair of elongated parallel leg portions extending from opposite sides of the head portion, and a connecting portion interconnecting to a leg portion of an adjoining section;

both of said pair of leg portions extending in a plane perpendicular to the plane of the tape over a portion of one side of the tape adjacent to one edge of the tape;

thread means securing the pair of leg portions of each section to the one side portion of the tape;

a pair of flexible elongated members spaced apart in a plane parallel to the attachment portion and extending throughout the length of the coupling element between and transverse the pair of leg portions of each section for maintaining the pair of leg portions of each section in spaced relationship;

each of said pair of leg portions of each section having a first groove positioned about midway of the respective leg portion and having a second groove positioned about one end of the respective leg portion;

said first and second grooves extending transversely in the leg portions and having V-shaped cross sections substantially less in area than the area of the cross sections of the pair of elongated members;

a pair of teeth projecting from the leg portions on the opposite sides of each of the first and second grooves;

said pair of leg portions of each section being biased against the pair of elongated members such that portions of the pair of elongated members are deformed by the teeth and into the grooves to interlock the pair of elongated members and the pairs of leg portions; and each of said teeth and respective sides of the grooves defining a planar surface engaging a substantial surface portion of one of the pairs of elongated members.

* * * * *